US007945190B2

(12) United States Patent
Kubo

(10) Patent No.: US 7,945,190 B2
(45) Date of Patent: May 17, 2011

(54) CLEANERLESS IMAGE FORMING APPARATUS

(75) Inventor: Norihiko Kubo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 750 days.

(21) Appl. No.: 11/959,346

(22) Filed: Dec. 18, 2007

(65) Prior Publication Data

US 2008/0152387 A1 Jun. 26, 2008

(30) Foreign Application Priority Data

Dec. 21, 2006 (JP) ..... 2006-344723

(51) Int. Cl.
*G03G 21/00* (2006.01)
*G03G 15/30* (2006.01)

(52) U.S. Cl. ..... 399/129; 399/149

(58) Field of Classification Search ..... 399/128–129, 399/149–150, 343
See application file for complete search history.

(56) References Cited

U.S. PATENT DOCUMENTS 4,769,676 A * 9/1988 Mukai et al. ..... 399/150

FOREIGN PATENT DOCUMENTS

| | | |
|---|---|---|
| JP | 63-149669 | 6/1988 |
| JP | 05-107875 | 4/1993 |
| JP | 2001-215798 | 8/2001 |
| JP | 2002-082573 | 3/2002 |
| JP | 2004-117599 | 4/2004 |
| JP | 2005-189319 | 7/2005 |

* cited by examiner

*Primary Examiner* — David M Gray
*Assistant Examiner* — Andrew V Do
(74) *Attorney, Agent, or Firm* — Canon USA Inc IP Division

(57) ABSTRACT

A cleanerless image forming apparatus removes and collects transfer residual toner for reuse by performing cleaning simultaneously with developing. The image forming apparatus includes first and second toner charging members configured to apply an electrical charge having the same polarity as a toner normal charging polarity to the transfer residual toner, and a discharging member that is configured to discharge a drum and is disposed between the first and second toner charging members.

5 Claims, 5 Drawing Sheets

CLEANERLESS IMAGE FORMING APPARATUS

BACKGROUND OF THE INVENTION

1. Field of the Invention

The present invention relates to image forming apparatuses using an electrophotographic method or an electrostatic recording method, and more particularly to an image forming apparatus such as a copier, a printer, or a facsimile machine.

2. Description of the Related Art

Transfer type image forming apparatuses such as copiers, printers, and facsimile machines which use a transfer type electrophotographic method include cleanerless image forming apparatuses that have no cleaning device for cleaning residual toner remaining on a drum after performance of a transfer process. Such cleanerless image forming apparatuses remove transfer residual toner remaining on a photosensitive member after performance of a transfer process and collect the removed toner for reuse by causing a developing device included therein to perform cleaning simultaneously with developing.

The cleaning performed simultaneously with developing is a method of collecting transfer residual toner remaining on a photosensitive member after performance of a transfer process, that is, toner that has not been transferred in the transfer process and remains on the photosensitive member, in a developing device in the next developing process. More specifically, the photosensitive member having the transfer residual toner thereon is electrically charged, the charged photosensitive member is exposed to light so as to form an electrostatic latent image thereon, and then the transfer residual toner is collected in the developing device using a fog removing bias when the electrostatic latent image is developed. Here, the fog removing bias means a fog removing potential difference Vback that is a difference between the potential of a direct current voltage to be applied to the developing device and the surface potential of the photosensitive member. Using the fog removing potential difference Vback, the transfer residual toner on a part (non-image portion) of the surface of the photosensitive member, which should not be developed, is collected in the developing device. By performing this method, the transfer residual toner is collected in the developing device, and the collected toner is reused for the development of an electrostatic latent image in the next developing process. Accordingly, no waste toner is generated, and easy maintenance can be achieved. Furthermore, since a waste-toner container is not required, this method is effective for the miniaturization of an image forming apparatus.

On the other hand, from the viewpoint of charging stability, a roller charging device that includes a conductive roller as a contact charging member is currently used instead of a corona charging device. In a roller charging method, a conductive elastic roller (charging roller) is brought into pressing contact with a member to be charged, and a voltage is applied to the roller, whereby the member to be charged is electrically charged.

In the case of this charging method, an AC charging method has been proposed and is in practical use (see, for example, Japanese Patent Laid-Open No. 63-149669). In the AC charging method, an AC component having a peak-to-peak voltage of a value equal to or larger than 2×Vth is superimposed on a DC voltage corresponding to a surface potential Vd of a desired member to be charged, and a voltage generated from this superimposition is applied to a contact charging member. The potential leveling effect can be produced by the AC component. Consequently, as compared with a DC charging method, the member to be charged can be more uniformly charged in this method. Furthermore, the potential of the member to be charged can be substantially maintained at a value Vd that is midway between the peaks of the AC voltage.

In cleanerless image forming apparatuses for removing transfer residual toner remaining on a photosensitive member after performance of a transfer process and collecting the removed toner in a developing device by performing the cleaning simultaneously with developing, if the above-described contact charging device is used as a charging device for the photosensitive member, the following disadvantages can be considered. That is, when the transfer residual toner on the photosensitive member passes through a charging portion that is a contact nip portion at which the photosensitive member contacts the contact charging device, the transfer residual toner is attached to the contact charging device. As a result, the contact charging device is contaminated by the toner to an unallowable degree, and hence the charging device becomes unable to sufficiently charge the photosensitive member.

The cause for the above-described phenomenon is that a small amount of toner material having a charging polarity opposite to a normal charging polarity is mixed with a toner material having the normal charging polarity in toner. Furthermore, even if a toner material has the normal charging polarity, under the influence of a transfer bias or separating discharge, the charging polarity of the toner material may be reversed, or the toner material may be diselectrified and the charge amount thereof may therefore be reduced.

That is, the transfer residual toner includes a toner material having a normal charging polarity, a toner material having a reverse charging polarity opposite to the normal charging polarity, and a toner material whose charge amount is small. The toner material having the reverse charging polarity and the toner material whose charge amount is small are prone to becoming attached to the contact charging device when passing through a charging portion that is a contact nip portion at which the photosensitive member contacts the contact charging device.

In order to allow a developing device to perform the cleaning simultaneously with developing so as to remove and collect the transfer residual toner on a photosensitive member, it is required that the charging polarity of the transfer residual toner, which is to be transferred to a developing portion through a charging portion, be a normal polarity and the toner charge amount of the photosensitive member be a charge amount allowing the developing device to develop an electrostatic latent image on the photosensitive member. If the transfer residual toner has the reverse charging polarity or the charge amount thereof is not appropriate, the transfer residual toner cannot be removed from the photosensitive member and be collected in the developing device. This causes a defective image to be formed.

An image forming apparatus is disclosed which includes a uniform transfer residual toner forming portion that is located downstream from a transfer portion and a toner charging portion that is located downstream from the uniform transfer residual toner forming portion and upstream from a charging portion for charging a photosensitive member (see, for example, Japanese Patent Laid-Open No. 2001-215798).

However, if a large amount of transfer residual toner is simultaneously produced due to the continuous printing of an image with a high printing ratio such as a photographic image, it is sometimes difficult to charge the toner material having the reverse polarity and the toner material having an improper potential level to a potential level at which a developing device can collect all of them. A technique for supplying a sufficient electrical charge to the transfer residual toner has been proposed in which a bias to be applied to a toner charging portion is made variable in accordance with the durability history so as to increase a charging ability of the toner charging portion (see, for example, Japanese Patent Laid-Open No. 2005-189319).

In the case of the image forming apparatus disclosed in Japanese Patent Laid-Open No. 2005-189319, in order to increase the charging ability of the toner charging portion, it is required that a large bias be applied to the toner charging portion. However, this causes an excessive load on a power supply.

SUMMARY OF THE INVENTION

The present invention provides a cleanerless image forming apparatus capable of removing and collecting transfer residual toner for reuse by performing the cleaning simultaneously with developing. Furthermore, the present invention provides an image forming apparatus capable of improving an ability to charge the transfer residual toner by controlling the power supply load of a toner charging portion.

An image forming apparatus according to an embodiment of the present invention includes: an image bearing member configured to bear a toner image; a charging unit configured to charge the image bearing member; a latent image forming unit configured to form an electrostatic latent image on the charged image bearing member; a development unit configured to develop the latent image using toner and collect residual toner that was not transferred in the last image forming process and remains on the image bearing member; a transfer unit configured to transfer the toner image formed on the image bearing member to a transfer material; a first toner charging unit configured to apply an electrical charge having the same polarity as a normal charging polarity to the residual toner, the first charging unit being disposed downstream from the transfer unit and upstream from the charging unit in a rotation direction of the image bearing member; a second toner charging unit configured to apply an electrical charge having the same polarity as the normal charging polarity to the residual toner, the second charging unit being disposed downstream from the first toner charging unit and upstream from the charging unit in the rotation direction of the image bearing member; and a discharging unit configured to discharge the image bearing member, the discharging unit being disposed between the first toner charging unit and the second toner charging unit.

Further features of the present invention will become apparent from the following description of exemplary embodiments with reference to the attached drawings.

DESCRIPTION OF THE EMBODIMENTS

An image forming apparatus according to an embodiment of the present invention will be described in detail below with reference to the accompanying drawings.

First Embodiment

Image Forming Apparatus

An embodiment of the present invention will be described in detail below by way of example with reference to the accompanying drawings. Here, it is to be noted that the sizes, materials, shapes and relative arrangements of components described in this embodiment should be changed as appropriate in accordance with the configuration of an apparatus according to an embodiment of the present invention or various conditions, and are not intended to limit the scope of the present invention to the following embodiment.

Figure 1:
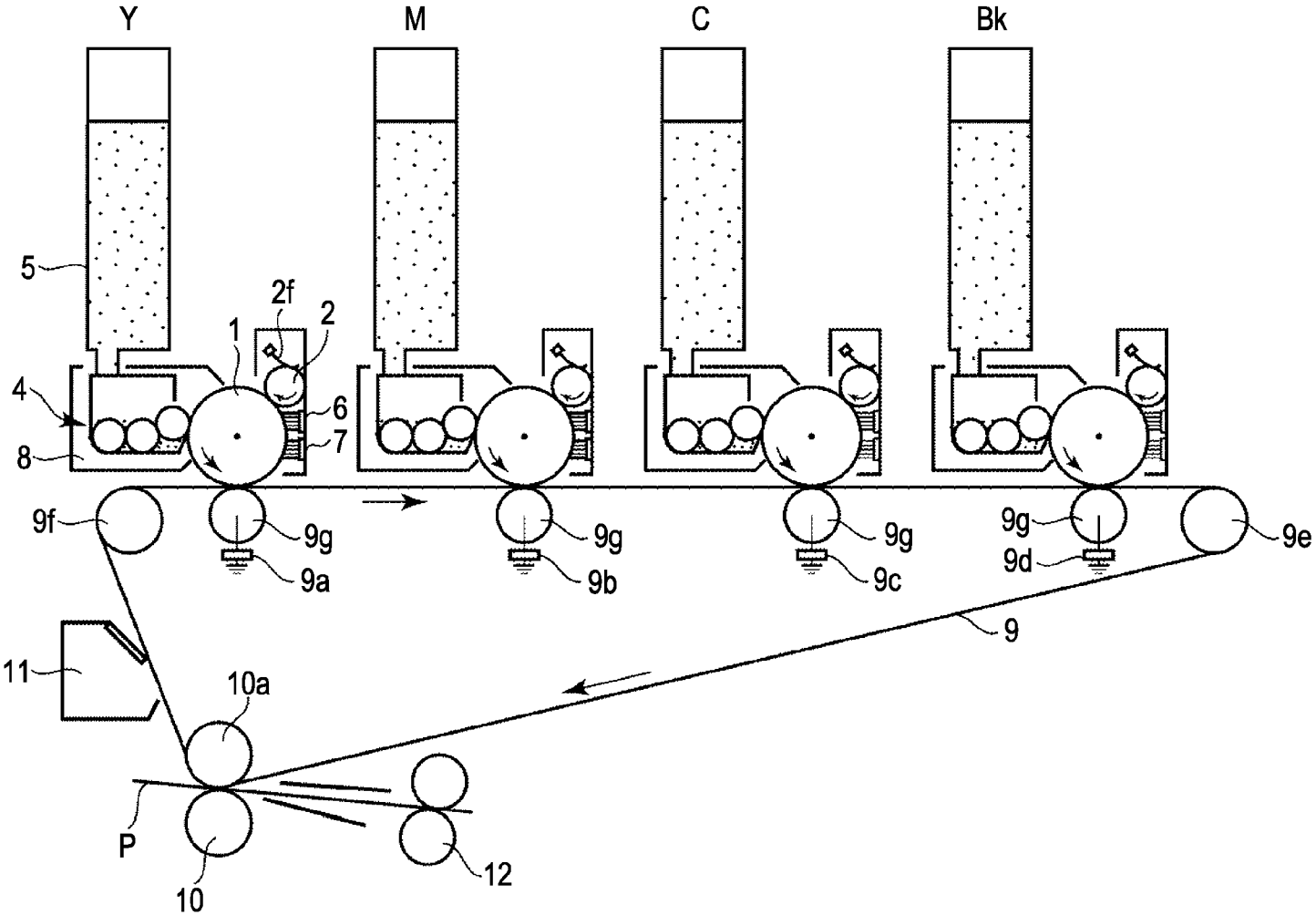
FIG. 1 is a schematic cross-sectional view of a color electrophotographic copying apparatus described in first and second embodiments.
Figure 2:
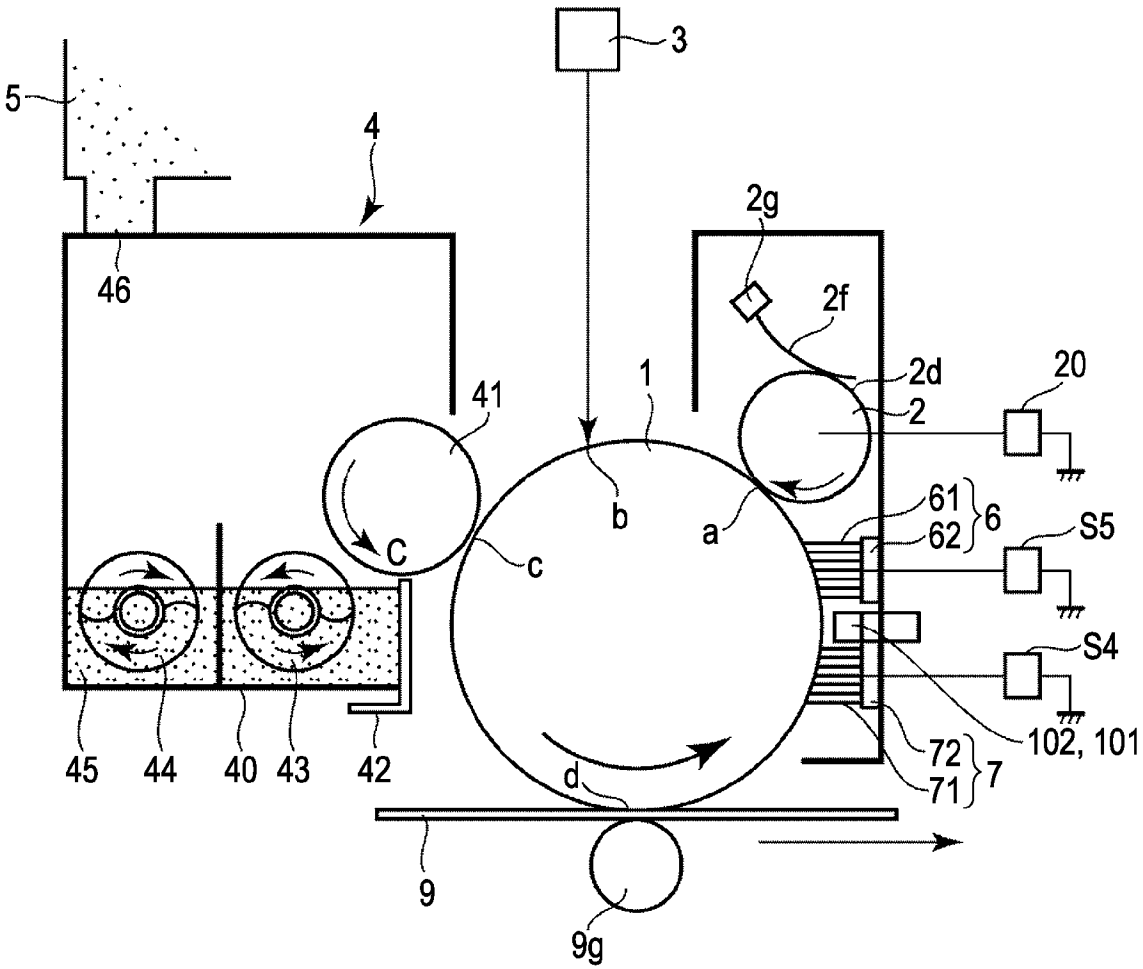
FIG. 2 is a schematic cross-sectional view illustrating the configuration of a portion around a photosensitive drum described in the first embodiment.

FIG. 1 is a schematic diagram illustrating the configuration of a main part of an image forming apparatus (image recording apparatus) according to an embodiment of the present invention. FIG. 2 is a schematic diagram illustrating the configuration of an image forming apparatus (image recording apparatus) according to an embodiment of the present invention.

An image forming apparatus illustrated in FIG. 1 is a color laser printer that uses a transfer type electrophotographic process, a contact charging system, a reversal developing system, a cleanerless system, and has the maximum sheet size of A3 size. An image forming apparatus according to this embodiment includes a plurality of process cartridges 8 (hereinafter referred to as P-GRGs). This color laser printer is also a (tandem) printer for performing multiple transfer, more specifically, for successively transferring toner from a plurality of photosensitive drums, which are arranged as first image bearing members, to an intermediate transfer belt 9 functioning as a second image bearing member so as to obtain a full color printed image. The image forming operation of the image forming apparatus is controlled by a control unit. In the following, the configuration of the image forming apparatus and the image forming operation thereof will be described.

Referring to FIG. 1, the endless intermediate transfer belt 9 is extended around a drive roller **9*e*, a tension roller 9*f*, and a secondary transfer counter roller 10*a*, and is rotated in a direction indicated by an arrow illustrated in FIG. 1**.

Four P-CRGs 8 are disposed in a line along a horizontal surface of the intermediate transfer belt 9 in the order of yellow Y, magenta M, cyan C and black Bk cartridges.

Next, description of the P-CRGs 8 will be made with reference to FIG. 2. In the following, description of one of the P-CRGs 8 which uses yellow toner for development will be made, but the other ones of P-CRGs 8 have the same configuration.

One of the P-CRGs 8 which uses yellow toner for development includes an electrophotographic photosensitive member (photosensitive drum) 1 functioning as a rotating drum image bearing member. The photosensitive drum 1 is an organic photoconductor (OPC) drum having an outer diameter of 30 mm, and is driven to rotate about its central support shaft in the counterclockwise direction indicated by an arrow illustrated in FIG. 2 at a process speed (circumferential speed) of 300 mm/sec.

The photosensitive drum 1 has an aluminum cylinder (conductive drum base), the surface of which is coated with a primer layer for suppressing interference of light and improving adhesivity of an upper layer, a photocharge generating layer, and a charge transfer layer (having a thickness of 20 μm) in the mentioned order from its center side.

Charging Unit

In a charging process, a predetermined voltage is applied from a power source 20 functioning as a first voltage applying unit to a charging roller 2 functioning as a contact charging device. Consequently, the surface of the photosensitive drum 1 is uniformly and negatively charged.

The longitudinal length of the charging roller 2 is 320 mm. The charging roller 2 is formed in such a manner that three layers, that is, a lower layer, a middle layer, and a surface layer 2*d*, are sequentially laminated around a core bar (supporting member) thereof from bottom (center side). The lower layer can be a foamed sponge layer for reducing charge sound, the middle layer can be a resistance layer for obtaining uniform resistance over the whole of the charging roller 2, and the surface layer 2*d* is a protection layer for preventing occurrence of leakage even when a defect, for example, a pin hole, exists on the photosensitive drum 1.

The charging roller 2 according to this embodiment uses a stainless circular rod having a diameter of 6 mm as the core bar, and a layer formed by dispersing carbon in fluorocarbon resin as the surface layer 2*d*. The outer diameter of the charging roller 2 is 14 mm, and the roller resistance thereof falls within a range of 104 to 107 Ω.

Both end portions of the core bar of the charging roller 2 are rotatably supported by bearing members. Furthermore, the charging roller 2 is urged toward the photosensitive drum 1 by a press spring, thereby being brought into pressing contact with the surface of the photosensitive drum 1 with a predetermined pressing force. Accordingly, the charging roller 2 rotates in synchronization with the rotation of the photosensitive drum 1.

By applying a predetermined oscillation voltage (bias voltage Vdc+Vac) obtained by superimposing an alternating voltage of a frequency f on a direct current voltage from the power source 20 via the core bar to the charging roller 2, the outer surface of the rotating photosensitive drum 1 is charged to a predetermined potential.

In this embodiment, the oscillation voltage is obtained by superimposing a sine wave of an alternating voltage (frequency f=1270 Hz, and peak-to-peak voltage Vpp=1700V) on a direct current voltage of −700 V. The outer surface of the photosensitive drum 1 is uniformly charged to −700 V (dark potential Vd) using a contact charging method.

Referring to FIG. 2, a flexible cleaning film 2*f* is a charging roller cleaning member. One end of the cleaning film 2*f* is fixed to the supporting member 2*g* that is disposed in parallel with a longitudinal direction of the charging roller 2 and performs reciprocating motion in the longitudinal direction by a constant amount. The cleaning film 2*f* is disposed such that it and the charging roller 2 form a contact nip on a surface near its free end.

The supporting member 2*g* is driven to perform reciprocating motion by the constant amount in the longitudinal direction by a printer drive motor via a gear train. Subsequently, the surface layer 2*d* of the charging roller is abraded by the cleaning film 2*f*. Consequently, an attached contaminant (fine powder toner, outside adding agent, or the like) is removed from the surface layer 2*d* of the charging roller 2.

Latent Image Forming Unit

After the photosensitive drum 1 has been uniformly charged to a predetermined polarity and a predetermined potential, the photosensitive drum 1 undergoes image exposure performed by an image exposure unit 3 functioning as the latent image forming unit (not illustrated). Consequently, an electrostatic latent image corresponding to a first color component image (yellow component image) of a desired color image is formed. The image exposure unit 3 is an exposure optical system for color separation and image formation of a colored draft image, and outputs a laser beam modulated in accordance with a time series electric digital pixel signal based on image information. In this embodiment, as the image exposure unit 3, a laser beam scanner using a semiconductor laser is used. The image exposure unit 3 outputs laser light that has been modulated in accordance with an image signal transmitted from a host device such as an image reading device (not illustrated) to a printer, thereby performing laser scanning exposure (image exposure) upon the uniformly charged surface of the photosensitive drum 1.

The potential of a portion of the surface of the photosensitive drum 1 which has been irradiated with laser light in the above-described laser scanning exposure is lowered. As a result, an electrostatic latent image corresponding to the image information used in the scanning exposure is formed on the surface of the photosensitive drum 1. In this embodiment, the potential of the exposed portion is set to −150 V.

Development Unit

Subsequently, the electrostatic latent image is developed using the toner of the first color of yellow by a first developing device 4 (yellow developing device) functioning as the development unit.

Here, the description of the first developing device 4 (yellow developing device) will be made with reference to FIG. 2.

The first developing device 4 is a two-component contact developing device (two-component magnetic brush developing device). The first developing device 4 includes a development container 40 and a nonmagnetic development sleeve 41. The development sleeve 41 includes a magnet roller (not illustrated) fixedly disposed therein, and is rotatably disposed in the development container 40 while the outer surface thereof is partially exposed externally. The first developing device 4 also includes a developer restricting blade 42, a two-component developer 45 that is the mixture of the toner and a magnetic carrier which are contained in the development container 40, and developer stirring members 43 and 44 disposed on the bottom side of the development container 40.

The developer restricting blade 42 is disposed for the development sleeve 41 with a predetermined gap therebetween. A developer thin layer is formed on the development sleeve 41 in accordance with rotation of the development sleeve 41 in a direction indicated by an arrow C.

The development sleeve 41 is disposed in such a manner that it opposes the photosensitive drum 1 via the smallest gap (hereinafter referred to as S-D gap) of 350 μm therebetween. A portion at which the photosensitive drum 1 and the development sleeve 41 are opposed to each other is a developing portion c. The development sleeve 41 is driven to rotate in a direction opposite to a traveling direction of the photosensitive drum 1 at the developing portion c. The developer thin layer on the development sleeve 41 is brought into contact with the surface of the photosensitive drum 1 at the developing portion c to moderately abrade the surface of the photosensitive drum. A predetermined developing bias is applied from a power source (not illustrated) to the development sleeve 41.

In this embodiment, the developing bias voltage to be applied to the development sleeve 41 is an oscillation voltage obtained by superimposing a direct current voltage (Vdc) and an alternating current voltage (Vac). More specifically, the developing bias voltage is an oscillation voltage obtained by superimposing Vdc=−550 V, Vac=1800 V, and frequency=2540 Hz.

The surface of the development sleeve 41 is coated with the thin layer using the developer. Toner materials included in the developer are transferred to the developing portion c, and are then selectively adhered to the surface of the photosensitive drum 1 in accordance with an electrostatic latent image under the influence of an electric field produced by the developing bias. Consequently, the electrostatic latent image is developed as a toner image. In this embodiment, toner materials having a negative polarity are adhered to an exposure bright portion on the surface of the photosensitive drum 1. Consequently, the reversal development of the electrostatic latent image is performed.

After the developer thin layer on the development sleeve 41 has passed through the developing portion c, the developer thin film layer is returned to a developer storage portion included in the development container 40 in accordance with the rotation of the development sleeve 41.

The first developing device 4 includes the stirring screws 43 and 44 for stirring the developer. Each of the stirring screws 43 and 44 rotates in synchronization with the rotation of the development sleeve 41, thereby stirring the replenished toner and the carrier to supply predetermined triboelectricity to the toner.

A sensor (not illustrated) for detecting the toner density of the developer by detecting a change in the magnetic permeability of the developer is disposed on a wall that exists upstream from the stirring screw 44 of the first developing device 4. A toner replenishing opening 46 is placed downstream from the sensor. After a developing operation has been performed, the developer is conveyed to the sensor for the detection of the toner density thereof. In order to maintain the toner density of the developer constant in accordance with the detection result, a screw (not illustrated) included in a developer supplying unit 5 (hereinafter referred to as the T-CRG 5) is rotated as appropriate, and then toner is replenished therefrom through the toner replenishing opening 46 of the first developing device 4.

The replenished toner is carried by the stirring screw 44, and is then mixed with the carrier. At that time, appropriate triboelectricity is supplied to the toner. Subsequently, the toner is conveyed near the development sleeve 41 and is then formed into the thin layer on the development sleeve 41 for development.

In this embodiment, a negatively charged toner having an average particle diameter of 6 μm is used as the toner, and a magnetic carrier having the saturation magnetization of 205 emu/cm3 (magnetization amount of 56.9 Am2/kg per 1000 gauss (0.1 T) (specific gravity of 3.6 g/cm3)) and an average particle diameter of 35 μm is used as the carrier. Furthermore, a mixture of the toner and the carrier by the weight ratio of 6:94 is used as the developer.

Furthermore, a charging amount of the toner developed on the photosensitive drum 1 is −25 μC/g.

Transfer Unit

Next, the description of the transfer unit will be made.

Referring to FIG. 1, the yellow image formed on the photosensitive drum 1 reaches a primary transfer nip portion that is formed by the photosensitive drum 1 and the intermediate transfer belt 9. At the transfer nip portion, one of transfer rollers 9*g* is brought into pressing contact with a rear surface of the intermediate transfer belt 9 by a predetermined pressing force. The transfer rollers 9*g* individually have primary transfer bias sources 9*a* to 9*d* as fourth voltage applying units. Consequently, biases can be separately applied to corresponding ports. The intermediate transfer belt 9 undergoes image transfer with yellow at a port for the first color. Subsequently, the intermediate transfer belt 9 sequentially undergoes image transfer from corresponding photosensitive drums 1 thereto with colors of magenta, cyan, and black, which have been processed as described above, at corresponding ports. Thus, the intermediate transfer belt 9 undergoes multiple transfer.

In this embodiment, in consideration of a transfer efficiency for the toner developed at an exposure portion (at a potential −150 V), a voltage of +350 V is applied to all of the first to fourth color images as the primary transfer bias. A four-color full color image formed on the intermediate transfer belt 9 is transferred from the intermediate transfer belt 9 to a transfer material P transmitted from a sheet feeding roller 12 by a secondary transfer roller 10. The transferred image is fused into place by a fixing device (not illustrated). Consequently, a color print image can be obtained.

Secondary transfer residual toner remaining on the intermediate transfer belt 9 is removed by a blade included in an intermediate transfer belt cleaner 11 so as to be prepared for the following image forming process.

At the time of selection of a material for the intermediate transfer belt 9, in order to improve registration at each of the above-described color ports, an expandable and contractible material should not be selected. A resin belt, a rubber belt including a metal core bar, or a resin and rubber belt can be used.

In this embodiment, a resin belt formed by dispersing carbon in PI (polyimide) and controlling the volume resistivity thereof to an order of 108 Ωcm is used. The thickness of the resin belt is 80 μm, the longitudinal length thereof is 320 mm, and the circumference thereof is 900 mm.

Furthermore, each of the transfer rollers 9*g* is a conductive sponge roller. The resistance of each of the transfer rollers 9*g* is equal to or lower than 106 Ω, the outer diameter thereof is 16 mm, and the longitudinal length thereof is 315 mm.

Charging Unit

Referring to FIG. 1, at a location where a cleaning blade is generally placed, a first toner charging unit 7 functioning as a first toner charging unit and a second toner charging unit 6 functioning as a second toner charging unit are brought into contact with the photosensitive drum 1. In this embodiment, both of the first toner charging unit 7 and the second toner charging unit 6 use brush members made from conductive fibers. When a bias having the same polarity as the normal toner charging polarity (here, negative polarity) is applied to each of the first toner charging unit 7 and the second toner charging unit 6, they apply an electrical charge having the same polarity as the normal toner charging polarity (here, negative polarity) to toner.

More specifically, the second toner charging unit 6 (second brush) includes a brush portion 61 at a horizontally oriented electrode plate 62. The first toner charging unit 7 (first brush) similarly includes a brush portion 71 at an electrode plate 72. The brush portions 61 and 71 are arranged to be brought into contact with the surface of the photosensitive drum 1 and to be fixedly supported by the electrode plate 62 and 72, respectively.

In this embodiment, only the first and second toner charging units are illustrated due to limited space. However, as a matter of course, in order to sufficiently charge toner, more than two toner charging units are used. Accordingly, for example, the configuration including the third and fourth toner charging units can be considered.

Resistance values of the brush portions 61 and 71 are controlled by including carbon or metal powder in fibers of rayon, acrylic, or polyester. The brush portions 61 and 71 can have a thickness equal to or smaller than 30 deniers and a density of 1,550 to 77,500 pieces/cm2 (1 to 500,000/inch2)

such that the brush portions 61 and 71 can uniformly be brought into contact with the surface of the photosensitive drum 1 and the transfer residual toner. In this embodiment, each of the brush portions 61 and 71 has the thickness of 6 deniers, the density of 15,500 pieces/cm2 (100,000 pieces/inch2), the fiber length of 5 mm, and the brush resistance of 6×103 Ω·cm.

The second toner charging unit 6 and the first toner charging unit 7 are brought into contact with the surface of the photosensitive drum 1 such that the incursion amounts of the brush portions 61 and 71 with respect to the surface of the photosensitive drum 1 become 1 mm and the width of contact nip portions thereof is set to 5 mm.

Discharging Unit

An intermediate exposure unit 101 is disposed between the first toner charging unit 7 and the second toner charging unit 6 as a discharging unit. The intermediate exposure unit 101 includes an LED exposure device 102. The LED exposure device 102 includes an LED array of a plurality of light-emitting diodes arranged in a single line along a direction orthogonal to a sheet transfer direction of a sheet transfer unit, and exposes a photosensitive member to light by performing on/off control of the light-emitting diodes and forms an electrostatic latent image on the photosensitive member. This LED array is fixed via a supporting member tiltable about an axis along the same direction as that of a rotation axis of an open/close cover. Accordingly, the above-described light-emitting diodes are directed toward the photosensitive drum 1 located below them. The wavelength of light emitted from the LED array is set to 780 nm in accordance with the spectral sensitivity characteristic of the drum. However, the wavelength of light may be set to various values in accordance with the sensitivity of a drum used.

Figure 4:
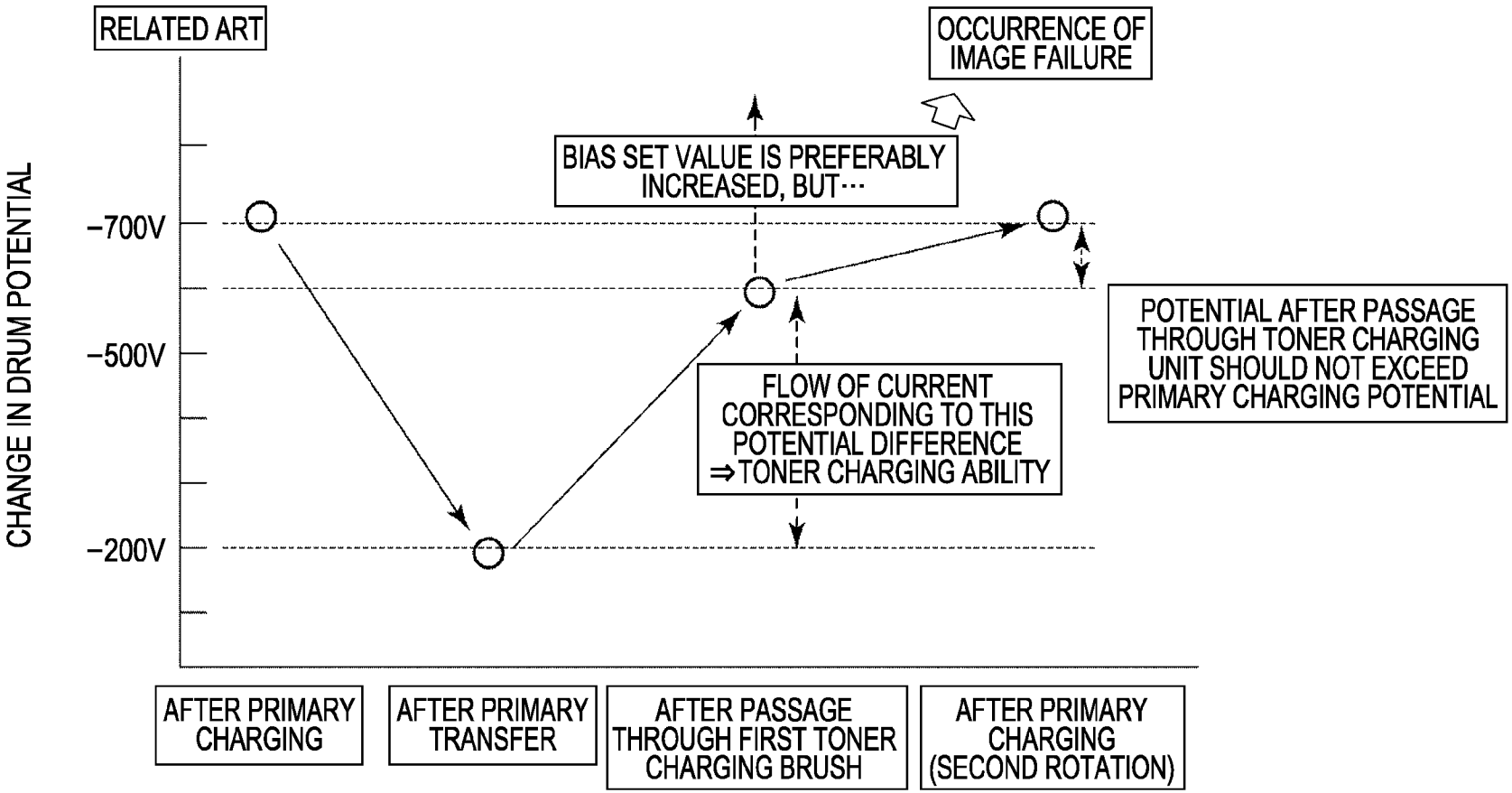
FIG. 4 PRIOR ART
FIG. 4 is a schematic diagram illustrating a change in a drum potential in an image forming apparatus according to a related art.

Here, the effect of the intermediate exposure unit 101, which is the characterizing portion of this embodiment, will be described while comparing the intermediate exposure unit 101 with the related art. As illustrated in the related art in FIG. 4, if a bias to be applied to the primary charging unit is set to −700 V as described previously, the potential of the photosensitive drum 1 is −700 V after the photosensitive drum 1 has passed through the charging roller 2 (primary charging unit). The potential of the charged portion is changed from −700 V to −200 V after the photosensitive drum 1 has passed through the intermediate transfer belt 9 (primary transfer unit). Accordingly, if a DC bias of −900 V is applied to the first toner charging brush, the first toner charging brush is discharged using the potential difference between the potential of −200 V obtained after the photosensitive drum 1 has passed through the intermediate transfer belt 9 (primary transfer unit) and the DC bias of −900 V applied to the first toner charging brush. In response to this discharge, the transfer residual toner passing through a nip portion of the first toner charging unit 7 is charged to the same polarity as a normal charging polarity (here, the negative charging polarity). In this description, the potential difference between the potential obtained after the photosensitive drum 1 has passed through the intermediate transfer belt 9 (primary transfer unit) and the DC bias applied to the first toner charging brush is referred to as a "transfer unit-to-charging brush contrast".

Usually, the higher the transfer unit-to-charging brush contrast, the more the amount of discharge from the first toner charging unit 7 to the photosensitive drum 1. Accordingly, the transfer residual toner can be easily charged to the normal charging polarity. However, if too much bias is applied to the first toner charging unit 7 so as to obtain a higher transfer unit-to-charging brush contrast, the potential of the photosensitive drum 1 obtained after passage through the toner charging brush is smaller than the bias of −700 V to be applied to the charging roller 2 (primary charging unit). That is, at the nip portion of the charging unit, the potential magnitude relationship between the surface potential of the photosensitive drum 1 and the potential of the charging unit is reversed. As a result, the negatively charged toner is electrostatically attracted to the charging unit. The charging unit is therefore contaminated by the toner. This causes a charging failure and an image failure. As described previously, if a bias to be applied to the first toner charging unit 7 is set to −900 V, the drum potential of −600 V can be obtained after the photosensitive drum 1 has passed through the first toner charging brush. Accordingly, in a cleanerless system, a bias larger than −900 V should not be applied to the first toner charging brush. However, if a bias to be applied to the first toner charging brush is not increased, the toner cannot be sufficiently charged in this product having a high process speed of 300 mm/s. Thus, as a result, the charging roller 2 (charging unit) is undesirably contaminated with the transfer residual toner and the fog toner. This poses a dilemma. Furthermore, even if the first toner charging unit 7 and the second toner charging unit 6 are merely installed, the same result obtained when a bias to be applied to the first toner charging unit 7 is increased is produced. That is, the drum potential obtained when the photosensitive drum 1 has passed through the second toner charging unit should not exceed a bias to be applied to the charging roller 2 (charging unit). A sufficient bias cannot therefore be applied to the second toner charging unit.

Figure 5:
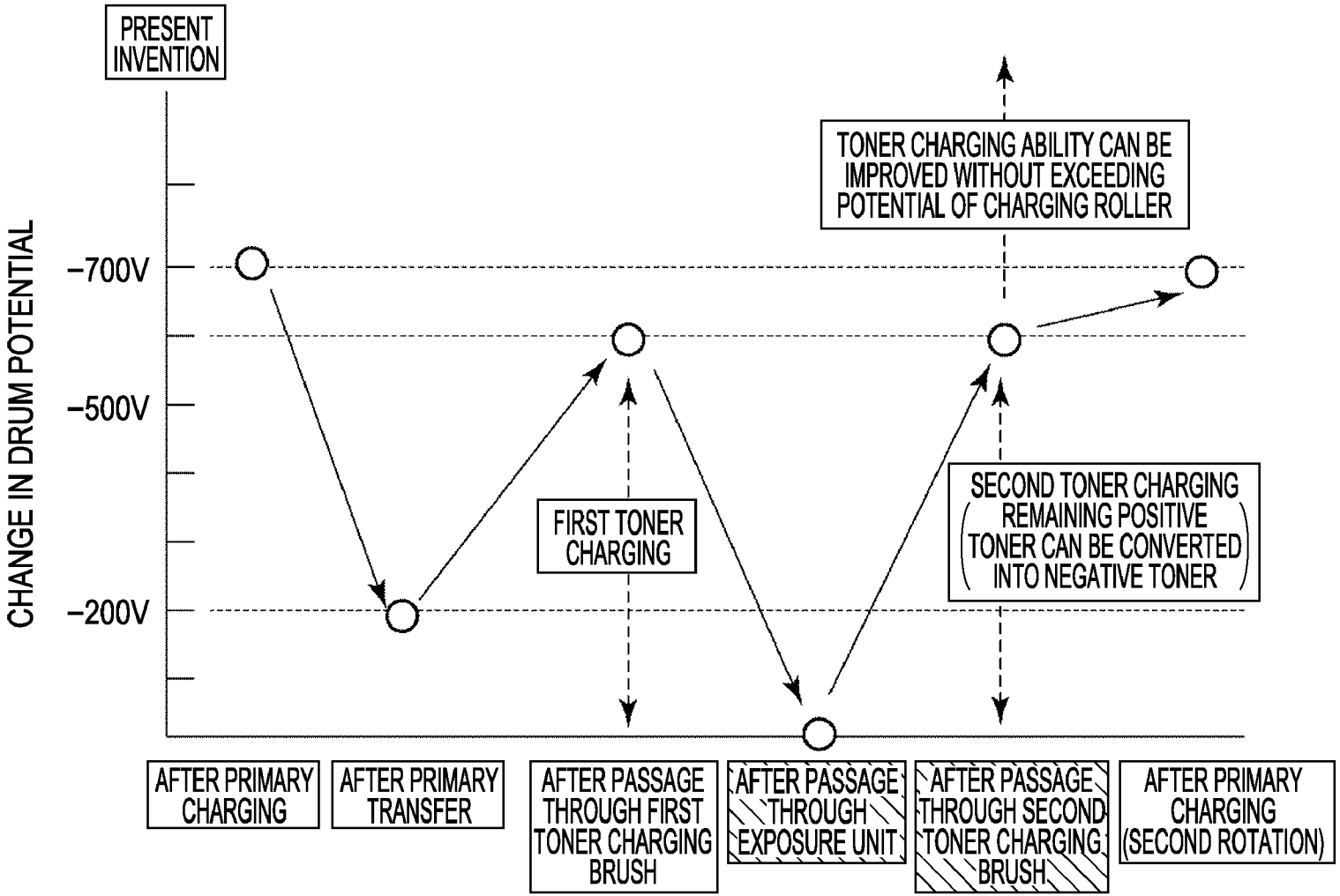
FIG. 5 is a schematic diagram illustrating a change in a drum potential in an image forming apparatus according to an embodiment of the present invention.

In this embodiment, as illustrated in FIG. 5, the intermediate exposure unit 101 is disposed between the first toner charging unit 7 and the second toner charging unit 6. By using this configuration, the drum potential (approximately −600 V) obtained after the photosensitive drum 1 has passed through the first toner charging unit 7 is canceled by the intermediate exposure unit 101. The drum potential obtained after the photosensitive drum 1 has passed through the intermediate exposure unit 101 therefore becomes approximately 0 V. Accordingly, a sufficient contrast between a bias to be applied to the second toner charging unit 6 and the drum potential obtained after the photosensitive drum 1 has passed through the intermediate exposure unit 101 (hereinafter referred to as an "exposure unit-to-second toner charging brush contrast") can be obtained. Consequently, even if a large bias cannot be applied to the second toner charging brush, the second toner charging operation can be performed. Furthermore, even if a large bias is applied to the second toner charging member, it is difficult for the drum potential obtained after the photosensitive drum 1 has passed through the second toner charging unit to exceed a bias to be applied to the charging roller 2 (charging unit), because the difference between them is large. Furthermore, the bias equal to or larger than that applied to the first toner charging unit can be applied to the second toner charging unit. That is, the magnitude relationship between the surface potential of the above-described image bearing member, which is obtained after the passage through the second toner charging unit 6 functioning as the second toner charging unit, and a DC bias to be applied to the charging unit is a relationship allowing the toner having the normal charging polarity to be attracted to the image bearing member when the image bearing member passes through the charging unit. Accordingly, the toner having the normal charging polarity is not attached to the charging unit. Furthermore, the transfer residual toner can be sufficiently charged to the same polarity as the normal charging polarity.

Table 1 shows the values of biases to be applied to the charging unit, the transfer unit, the first toner charging member, and the second toner charging member, the drum potentials obtained after the drum has passed through these units, and the results of image evaluation after the image forming apparatus has produced copy of 100,000 sheets using or without using the intermediate exposure unit.

TABLE 1

| Bias to be applied to charging unit | Drum potential after passage through charging unit | Bias to be applied to transfer unit | Drum potential after passage through transfer unit | Bias to be applied to first toner charging unit | Drum potential after passage through first toner charting unit | Use of intermediate exposure unit | Drum potential after passage through intermediate exposure unit | Bias to be applied to second toner charging unit | Drum potential after passage through second toner charging unit | Image evaluation after copy of 100,000 sheets |
|---|---|---|---|---|---|---|---|---|---|---|
| −700 V | −700 V | +350 V | −200 V | −900 V | −600 V | with | 0 V | −900 V | −500 V | ○ (good) |
| −700 V | −700 V | +350 V | −200 V | −900 V | −600 V | with | 0 V | −700 V | −400 V | ○ (good) |
| −700 V | −700 V | +350 V | −200 V | −900 V | −600 V | with | 0 V | −500 V | −300 V | ○ (good) |
| −700 V | −700 V | +350 V | −200 V | −700 V | −500 V | with | 0 V | −900 V | −500 V | ○ (good) |
| −700 V | −700 V | +350 V | −200 V | −700 V | −500 V | with | 0 V | −700 V | −400 V | ○ (good) |
| −700 V | −700 V | +350 V | −200 V | −700 V | −500 V | with | 0 V | −500 V | −300 V | ○ (good) |
| −700 V | −700 V | +350 V | −200 V | −900 V | −600 V | without | −600 V | −900 V | −800 V | X (NG Charging member is contaminated, because potential of charging member is lower than drum potential.) |
| −700 V | −700 V | +350 V | −200 V | −900 V | −600 V | without | −600 V | −500 V | −600 V | X (NG Charging member is contaminated, because toner cannot be sufficiently charged by second toner charging unit.) |
| −700 V | −700 V | +350 V | −200 V | −700 V | −500 V | without | −500 V | −900 V | −700 V | X (NG Charging member is contaminated, because potential of charging member is lower than drum potential.) |
| −700 V | −700 V | +350 V | −200 V | −700 V | −500 V | without | −500 V | −500 V | −500 V | X (NG Charging member is contaminated, because toner cannot be sufficiently charged by second toner charging unit.) |
| −700 V | −700 V | +350 V | −200 V | −700 V | −500 V | without | −500 V | −1200 V | −1000 V | X (NG Charging member is contaminated, because potential of charging member is lower than drum potential.) |
| −500 V | −500 V | +350 V | −100 V | −900 V | −600 V | with | 0 V | −900 V | −500 V | ○ (good) |
| −500 V | −500 V | +350 V | −100 V | −700 V | −500 V | with | 0 V | −700 V | −400 V | ○ (good) |
| −500 V | −500 V | +350 V | −100 V | −900 V | −600 V | without | −600 V | −500 V | −500 V | X (NG Charging member is contaminated, because toner cannot be sufficiently charged by second toner charging unit.) |
| −500 V | −500 V | +350 V | −100 V | −700 V | −500 V | without | −500 V | −1200 V | −1000 V | X (NG Charging member is contaminated, because potential of charging member is lower than drum potential.) |

That is, the second toner charging unit 6 and the first toner charging unit 7 are controlled by a control unit and the intermediate exposure unit 101, whereby the amount of toner charge and the drum potential are controlled. Thus, a cleanerless system according to this embodiment is achieved.

The transfer residual toner on the photosensitive drum 1 passes through an exposure portion b. Accordingly, the exposure process is performed upon the photosensitive drum 1 having the transfer residual toner thereon. However, since the amount of the transfer residual toner is small, no special problem arises.

Second Embodiment

Like the first embodiment, the description of an image forming apparatus (image recording apparatus) according to an embodiment of the present invention will be made with reference to a schematic configuration diagram illustrated in FIG. 3.

Figure 3:
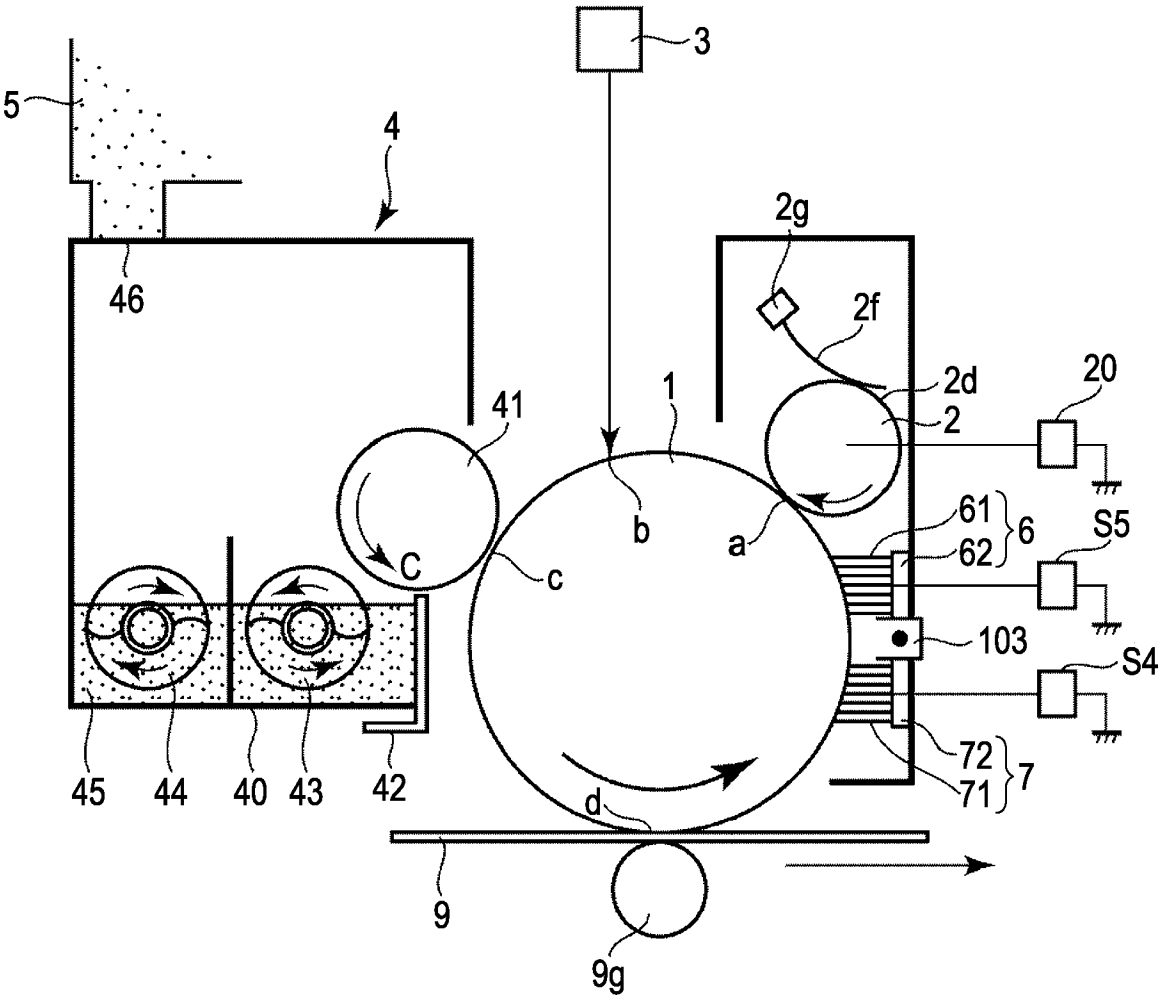
FIG. 3 is a schematic cross-sectional view illustrating the configuration of a portion around a photosensitive drum described in the second embodiment.

As illustrated in FIG. 3, the same effects can be also obtained using a noncontact discharging unit 103 instead of the intermediate exposure unit 101 according to the first embodiment. As the noncontact discharging unit 103, a corona discharging device is used. The corona discharging device employs a discharging method using scorotron charging. In the following, an example in which the most commonly used scorotron charging method is used will be described. However, this embodiment is not limited to the scorotron charging method. The ion implantation discharging method or various known techniques may be used. The corona discharging device functioning as a discharging unit performs a discharging operation when a voltage of up to 10 KV that is equal to a current of about 1500 μA is applied to a discharge wire. In this embodiment, a voltage of about +5 KV that is equal to a current of about 700 μA is applied to a discharge wire. In this embodiment, a single discharge wire is used. However, two or more discharge wires may be used. Furthermore, a discharge wire that includes an anti-oxidizing surface layer and is made of a conducting material or a discharge wire made of a dischargeable conducting material such as a needle electrode or a sawtooth electrode may be used.

The grid of the corona discharging device is made of a stainless material (for example, SUS304 or SUS430) having a diameter of 50 μm to 200 μm or another conducting material. A grid having a particular pattern such as a mesh pattern generated by performing edging upon a metal conductive material may be used.

Table 2 shows the values of biases to be applied to the charging unit, the transfer unit, the first toner charging member, and the second toner charging member, the drum potentials obtained after the drum has passed through these units, and the results of image evaluation after the image forming apparatus has produced copy of 100,000 sheets using or without using the noncontact discharging unit 103 (corona discharging device).

TABLE 2

| Bias to be applied to charging unit | Drum potential after passage through charging unit | Bias to be applied to transfer unit | Drum potential after passage through transfer unit | Bias to be applied to first toner charging unit | Drum potential after passage through first toner charting unit | Use of corona discharging unit | Drum potential after passage through corona discharging unit | Bias to be applied to second toner charging unit | Drum potential after passage through second toner charging unit | Image evaluation after copy of 100,000 sheets |
|---|---|---|---|---|---|---|---|---|---|---|
| −700 V | −700 V | +350 V | −200 V | −900 V | −600 V | with | 0 V | −900 V | −500 V | ○ (good) |
| −700 V | −700 V | +350 V | −200 V | −900 V | −600 V | with | 0 V | −700 V | −400 V | ○ (good) |
| −700 V | −700 V | +350 V | −200 V | −900 V | −600 V | with | 0 V | −500 V | −300 V | ○ (good) |
| −700 V | −700 V | +350 V | −200 V | −700 V | −500 V | with | 0 V | −900 V | −500 V | ○ (good) |
| −700 V | −700 V | +350 V | −200 V | −700 V | −500 V | with | 0 V | −700 V | −400 V | ○ (good) |
| −700 V | −700 V | +350 V | −200 V | −700 V | −500 V | with | 0 V | −500 V | −300 V | ○ (good) |
| −700 V | −700 V | +350 V | −200 V | −900 V | −600 V | without | −600 V | −900 V | −800 V | X (NG Charging member is contaminated, because potential of charging member is lower than drum potential.) |
| −700 V | −700 V | +350 V | −200 V | −900 V | −600 V | without | −600 V | −500 V | −600 V | X (NG Charging member is contaminated, because toner cannot be sufficiently charged by second toner charging unit.) |
| −700 V | −700 V | +350 V | −200 V | −700 V | −500 V | without | −500 V | −900 V | −700 V | X (NG Charging member is contaminated, because potential of charging member is lower than drum potential.) |
| −700 V | −700 V | +350 V | −200 V | −700 V | −500 V | without | −500 V | −500 V | −500 V | X (NG Charging member is contaminated, because toner cannot be sufficiently charged by second toner charging unit.) |
| −700 V | −700 V | +350 V | −200 V | −700 V | −500 V | without | −500 V | −1200 V | −1000 V | X (NG Charging member is contaminated, because potential of charging member is lower than drum potential.) |
| −500 V | −500 V | +350 V | −100 V | −900 V | −600 V | with | 0 V | −900 V | −500 V | ○ (good) |
| −500 V | −500 V | +350 V | −100 V | −700 V | −500 V | with | 0 V | −700 V | −400 V | ○ (good) |
| −500 V | −500 V | +350 V | −100 V | −900 V | −600 V | without | −600 V | −500 V | −500 V | X (NG Charging member is contaminated, because toner cannot be sufficiently charged by second toner charging unit.) |

TABLE 2-continued

| Bias to be applied to charging unit | Drum potential after passage through charging unit | Bias to be applied to transfer unit | Drum potential after passage through transfer unit | Bias to be applied to first toner charging unit | Drum potential after passage through first toner charting unit | Use of corona discharging unit | Drum potential after passage through corona discharging unit | Bias to be applied to second toner charging unit | Drum potential after passage through second toner charging unit | Image evaluation after copy of 100,000 sheets |
|---|---|---|---|---|---|---|---|---|---|---|
| −500 V | −500 V | +350 V | −100 V | −700 V | −500 V | without | −500 V | −1200 V | −1000 V | X (NG Charging member is contaminated, because potential of charging member is lower than drum potential.) |

Like the first embodiment, the second toner charging unit 6 and the first toner charging unit 7 are controlled by the control unit and the noncontact discharging unit 103 (corona discharging device), whereby the amount of toner charge and the drum potential are controlled. Thus, a cleanerless system according to this embodiment is achieved.

If the second toner charging unit cannot be sufficiently discharged, the toner cannot be sufficiently charged to a normal toner charging polarity. As a result, a charging failure occurs. Even if the absolute value of the bias of the second toner charging unit is merely increased when the second toner charging unit is sufficiently discharged, the drum potential obtained after the drum has passed through the second toner charging unit is smaller than a bias to be applied to the charging unit. Accordingly, the potential magnitude relationship between the charging unit and the drum is reversed. This causes a situation in which the charging member is contaminated by the charged toner having the normal toner charging polarity. Accordingly, a charging failure occurs. In this embodiment, effective toner charging cannot be achieved without the noncontact discharging unit 103 (corona discharging device). An example in which a charging unit according to this embodiment performs injection charging by injecting an electrical charge into the drum in a contact manner has been described. However, this embodiment is not limited to the above-described example. The charging unit may be disposed near the drum and may charge the drum in a noncontact manner.

According to an embodiment of the present invention, there can be provided a cleanerless image forming apparatus capable of removing and collecting transfer residual toner for reuse by performing the cleaning simultaneously with developing. Furthermore, there can be provided an image forming apparatus that has an improved ability to charge the transfer residual toner and can also prevent toner from being electrostatically attached to a charging unit by preventing the reversal of a potential magnitude relationship between an image bearing member and the charging unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-344723 filed Dec. 21, 2006, which is hereby incorporated by reference herein in its entirety.

What is claimed is:

1. An image forming apparatus comprising:

an image bearing member configured to bear a toner image;

charging means configured to charge the image bearing member;

latent image forming means configured to form an electrostatic latent image on the charged image bearing member;

development means configured to develop the latent image using toner and collect residual toner that was not transferred in the last image forming process and remains on the image bearing member;

transfer means configured to transfer the toner image formed on the image bearing member to a transfer material;

first toner charging means, to which at least a direct current voltage having the same polarity as a normal charging polarity of toner is applied, configured to apply an electrical charge to the residual toner, the first charging means being disposed downstream from the transfer means and upstream from the charging means along a rotation direction of the image bearing member;

second toner charging means, to which a direct current voltage having the same polarity as a normal charging polarity of toner is applied, configured to apply an electrical charge to the residual toner, the second charging means being disposed downstream from the first toner charging means and upstream from the charging means along the rotation direction of the image bearing member; and discharging means configured to discharge the image bearing member, the discharging means being disposed downstream from the first toner charging means and upstream from the second toner charging means along the rotation direction of the image bearing member.

2. The image forming apparatus according to claim 1, wherein a magnitude relationship between a surface potential of the image bearing member after passage through the second toner charging means and a potential of a DC bias to be applied to the charging means is a relationship allowing toner having the normal charging polarity to be directed toward the image bearing member when the toner passes through the charging means.

3. The image forming apparatus according to claim 1, wherein, when the normal charging polarity of the toner is a negative polarity, the surface potential of the image bearing member after passage through the second toner charging means is Va, and the potential of the DC bias to be applied to the charging means is Vb, Va>Vb is satisfied.

4. The image forming apparatus according to claim 1, wherein the first toner charging means is brought into contact with the image bearing member, wherein the second toner charging means is brought into contact with the image bearing member, and wherein the discharging means discharges the image bearing member with light.

5. The image forming apparatus according to claim 1, wherein the charging means is brought into contact with the image bearing member.

* * * * *